US011083315B2

(12) United States Patent
Park et al.

(10) Patent No.: US 11,083,315 B2
(45) Date of Patent: Aug. 10, 2021

(54) DISPOSABLE FOLDABLE EATING UTENSIL

(71) Applicant: CJ CHEILJEDANG CORPORATION, Seoul (KR)

(72) Inventors: Kwang Soo Park, Gwacheon-si (KR); Ki Pyo Kim, Seoul (KR); Ki Min Rhyu, Seoul (KR); Kyoung Sik Cho, Seoul (KR); Gyu Hwan Cha, Seoul (KR)

(73) Assignee: CJ CHEILJEDANG CORPORATION, Seoul (KR)

( * ) Notice: Subject to any disclaimer, the term of this patent is extended or adjusted under 35 U.S.C. 154(b) by 0 days.

(21) Appl. No.: 16/470,994

(22) PCT Filed: Dec. 26, 2017

(86) PCT No.: PCT/KR2017/015506
§ 371 (c)(1),
(2) Date: Jun. 19, 2019

(87) PCT Pub. No.: WO2018/124710
PCT Pub. Date: Jul. 5, 2018

(65) Prior Publication Data

US 2020/0022515 A1 Jan. 23, 2020

(30) Foreign Application Priority Data

Dec. 27, 2016 (KR) ..... 20-2016-0007557
Oct. 16, 2017 (KR) ..... 10-2017-0133902

(51) Int. Cl.
*A47G 21/04* (2006.01)
*A47G 21/00* (2006.01)

(52) U.S. Cl.
CPC ..... *A47G 21/04* (2013.01); *A47G 2021/002* (2013.01)

(58) Field of Classification Search
CPC .. G47G 21/04; G47G 2021/002; A47G 21/04; A47G 2021/002
(Continued)

(56) References Cited

U.S. PATENT DOCUMENTS 4,356,667 A * 11/1982 Malachowski ..... E05D 15/22 49/161
4,615,120 A * 10/1986 Newman ..... A47G 21/02 16/227
(Continued)

FOREIGN PATENT DOCUMENTS

CN 2297136 Y 11/1998
CN 102824081 A 12/2012
(Continued)

OTHER PUBLICATIONS

International Search Report and Written Opinion for corresponding Patent Application No. PCT/KR2017/015506 dated May 15, 2018.
(Continued)

*Primary Examiner* — Phong H Nguyen
(74) *Attorney, Agent, or Firm* — Renner, Otto, Boisselle & Sklar, LLP

(57) ABSTRACT

The present application relates to a disposable foldable eating utensil comprising: a body; a handle extending from the distal end of the body; and a bendable part formed between the body and the handle to be thinner than the other parts so as to allow the handle to be folded and unfolded, wherein the body comprises a protrusion protruding downward from the bottom surface of the distal end thereof, the protrusion comprises an engaging ledge protruding outward from the periphery thereof, and the handle comprises an extension piece extending at a predetermined thickness from the tip end thereof and having a through-hole passing through the upper surface and the bottom surface thereof.

10 Claims, 5 Drawing Sheets

(58) Field of Classification Search
USPC ..... 30/322–328, 129, 124, 125, 137
See application file for complete search history.

(56) References Cited

U.S. PATENT DOCUMENTS

| | | | | |
|---|---|---|---|---|
| 4,826,033 | A * | 5/1989 | Satoh | A47G 21/02 30/322 |
| 5,137,239 | A | 8/1992 | Horton | |
| 5,940,974 | A | 8/1999 | Lee | |
| 5,945,606 | A | 8/1999 | Tokunaga et al. | |
| 6,994,434 | B2 * | 2/2006 | Blanchette | G02C 5/146 16/228 |
| 10,016,021 | B2 * | 7/2018 | Drage | A44B 17/0023 |
| 2003/0029044 | A1 * | 2/2003 | Mattson | A47G 21/02 30/324 |
| 2009/0144991 | A1 * | 6/2009 | Synnestvedt | A47J 43/281 30/324 |
| 2014/0137413 | A1 | 5/2014 | Hanif et al. | |

FOREIGN PATENT DOCUMENTS

| | | | |
|---|---|---|---|
| CN | 204192236 | U | 3/2015 |
| CN | 205162658 | U | 4/2016 |
| CN | 205682896 | U | 11/2016 |
| IT | VI20110091 | A1 | 10/2012 |
| JP | S43-019802 | | 8/1968 |
| JP | S50-029623 | U | 4/1975 |
| JP | S61-102172 | U | 6/1986 |
| JP | S62-078178 | U | 5/1987 |
| JP | H04-000268 | U | 1/1992 |
| JP | H04-034972 | U | 3/1992 |
| JP | 2001-299548 | A | 10/2001 |
| JP | 2013-027555 | A | 2/2013 |
| JP | 2016-075345 | | 5/2016 |
| KR | 20-0242256 | Y1 | 9/2001 |
| KR | 20-0290731 | Y1 | 10/2002 |
| KR | 20-0324527 | Y1 | 8/2003 |
| KR | 10-1317636 | B1 | 10/2013 |
| RU | 128464 | U1 | 5/2013 |
| WO | 2012/153113 | A1 | 11/2012 |
| WO | 2016/002871 | A1 | 1/2016 |

OTHER PUBLICATIONS

Nikhil Joshi et al., "Managing Extended Producer Responsibility using PLM Part 2: Identification of Joints for End-of-life Treatment Planning", Computer-Aided Design and Applications, 2008, 5(6), 764-773.

Examination Report for corresponding Australian Patent Application No. 2017384854 dated Dec. 3, 2019.

Office Action for corresponding Chinese Patent Application No. 201780081029.9 dated Feb. 3, 2020 along with the translation.

Office Action for corresponding Russian Patent Application No. 2019123444 dated Jan. 10, 2020 along with the translation.

Extended European Search Report dated Jul. 29, 2020, for corresponding European Patent Application No. 17888916.8.

Office Action dated May 31, 2021 for corresponding Korean Patent Application No. 10-2017-0133902.

* cited by examiner

DISPOSABLE FOLDABLE EATING UTENSIL

TECHNICAL FIELD

The present application relates to a disposable foldable eating tool for firmly maintaining a coupled state of a handle in an unfolded state and a body, thereby facilitating eating food.

BACKGROUND ART

Ordinary homes and restaurants have eating tools such as spoons, chopsticks, forks, and the like, and people can eat food using the eating tools.

However, people may have difficulty eating food in situations in which eating tools are not provided in outdoor places.

In this case, disposable eating tools such as that disclosed in KR Utility Model No. 20-0242256 (published on Sep. 25, 2001) may be used.

The disposable eating tools are sold in various places such as convenience stores and are readily available in the vicinity. Therefore, people may use the disposable eating tools in situations in which eating tools are not provided, thereby solving difficulty in eating food.

Meanwhile, various kinds of instant foods are sold in the market.

The instant foods can be cooked simply through a microwave oven. Accordingly, it is possible to reduce time taken to cook the instant foods, and anyone can get a uniform taste regardless of the skill of cooking.

In this case, a spoon is required to eat instant food such as rice, soup, stew, or the like. Therefore, instant food manufacturers or instant food sellers provide disposable spoons together with instant foods, thereby facilitating eating the instant foods in outdoor places.

Here, some of the disposable spoons are formed in a foldable type.

That is, a handle extending from a body of a disposable spoon is folded or unfolded. The handle is folded to minimize the volume when the disposable spoon is stored, and is unfolded to enable a user to easily grasp the disposable spoon for eating food.

However, the disposable foldable spoon in the related art has a problem in that, in the process of eating food, the handle is frequently unintentionally folded due to a loosely coupled state of the handle in the unfolded state and the body, thereby causing the user to feel an inconvenience to eat food.

For the above reason, relevant companies have made attempts to develop a disposable foldable eating tool for firmly maintaining a coupled state of a handle in an unfolded state and a handle to prevent the handle from being unintentionally folded in a process of eating food, but have not obtained satisfactory results until now.

DISCLOSURE

Technical Problem

Aspects of the present application are to address at least the above-mentioned problems and/or disadvantages and to provide at least the advantages described below. Accordingly, an aspect of the present application is to provide a disposable foldable eating tool for solving the problem that when the user uses the disposable foldable eating tool in the related art, the handle is frequently unintentionally folded in the process of eating food due to the loosely coupled state of the handle in the unfolded state and the body, thereby causing the user to feel an inconvenience to eat food.

Technical Solution

In accordance with an aspect of the present application, a disposable foldable eating tool includes a body, a handle extending from a distal end of the body, and a bending part formed between the body and the handle, the bending part being formed to be thinner than the other parts to allow the handle to be folded or unfolded. The body includes a protrusion protruding downward from a bottom surface of a distal end portion of the body, and the protrusion includes an outwardly protruding stopper around a lower end of the protrusion. The handle includes an extension piece with a constant thickness that extends from a tip end of the handle and has a through-hole formed through a top surface and a bottom surface of the extension piece.

Advantageous Effects

In the disposable foldable eating tool according to the present application, the body includes the protrusion including the stopper, and the handle includes the extension piece having the through-hole formed therein. When the handle is unfolded, the extension piece and the protrusion are engaged with each other, and the stopper passing through the through-hole is stopped by the circumference of the one end of the through-hole. Accordingly, the protrusion is prevented from being separated from the through-hole, and thus the body and the handle may be firmly coupled together.

MODE FOR INVENTION

Hereinafter, the present application will be described in detail with reference to the accompanying drawings.

While the accompanying drawings illustrate a disposable foldable spoon as a disposable foldable eating tool, this is merely illustrative, and the present application is applicable to other forms of eating tools such as disposable foldable forks or chopsticks without any specific limitation.

Figure 1:
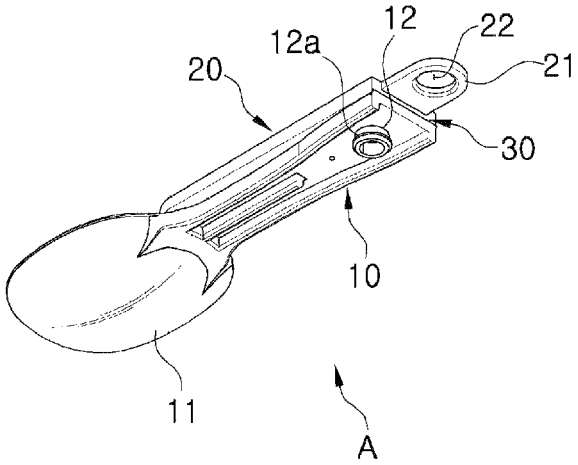
FIG. 1 is a rear perspective view of a disposable foldable spoon according to an embodiment of the present application, where the disposable foldable spoon is in a not-in-use state.
Figure 2:
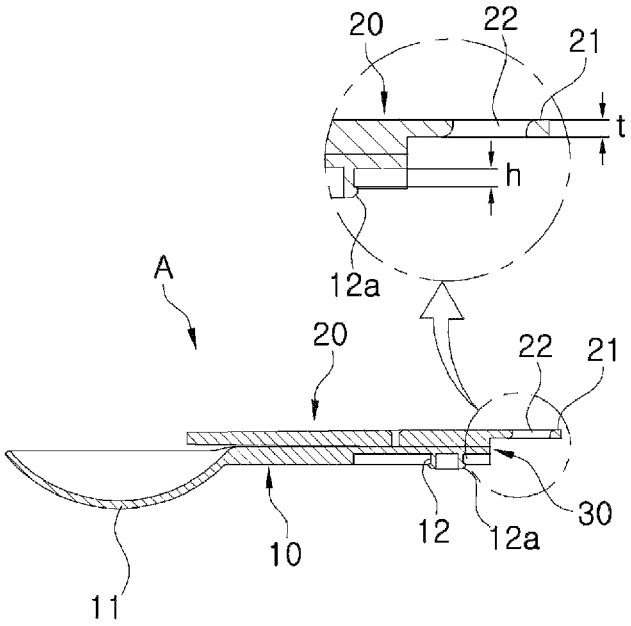
FIG. 2 is a sectional view of the disposable foldable spoon illustrated in FIG. 1.

As illustrated in FIGS. 1 and 2, a disposable foldable spoon A according to the present application includes a body 10, a handle 20, and a bending part 30.

The body 10 has a bowl 11 formed at the tip end thereof.

The body 10 includes a protrusion 12 protruding downward from the bottom surface of a distal end portion thereof.

The protrusion 12 is inserted into a through-hole 22 formed through an extension piece 21 of the handle 20, which will be described below, when the handle 20 is unfolded.

At this time, the protrusion 12 is smoothly inserted into the through-hole 22 because the protrusion 12 is formed in a circular shape having no angulated portion.

The protrusion 12 includes an outwardly protruding stopper 12*a* around a lower end thereof.

When the protrusion 12 is inserted into the through-hole 22, the stopper 12*a* passes through the through-hole 22 and is then stopped by the circumference of one end of the through-hole 22, and therefore the protrusion 12 is prevented from being unintentionally separated from the through-hole 22.

The stopper 12*a* is formed such that a height h from an upper end of the stopper 12*a* to an upper end of the protrusion 12 is equal to the thickness t of the extension piece 21. Accordingly, a vertical movement of the extension piece 21 is prevented when the stopper 12*a* is stopped by the circumference of the one end of the through-hole 22.

The stopper 12*a* is formed such that the outer diameter of a lower end portion is smaller than the outer diameter of an upper end portion. In other words, the stopper 12*a* is formed in a wedge shape. Accordingly, the stopper 12*a* is easily inserted into the through-hole 22.

The stopper 12*a* is formed such that the outer diameter of the upper end portion of the stopper 12*a* is larger than the inner diameter of the through-hole 22. Accordingly, when the protrusion 12 is inserted into the through-hole 22, the upper end of the stopper 12*a* passing through the through-hole 22 is fixedly stopped by the circumference of the one end of the through-hole 22. In this case, the protrusion 12 is formed in a hollow shape to allow elastic deformation of the stopper 12*a* as well as the protrusion 12. Accordingly, even though the outer diameter of the upper end portion of the stopper 12*a* is larger than the inner diameter of the through-hole 22, the stopper 12*a* is smoothly inserted into the through-hole 22.

The handle 20 extends from a distal end of the body 10.

The handle 20 includes the extension piece 21 with a constant thickness that extends from the tip end of the handle 20 and has the through-hole 22 formed through the top and bottom surfaces of the extension piece 21.

Accordingly, when the handle 20 is unfolded, the protrusion 12 of the body 10 is inserted into the through-hole 22, and the extension piece 21 and the protrusion 12 are engaged with each other.

Figure 5:
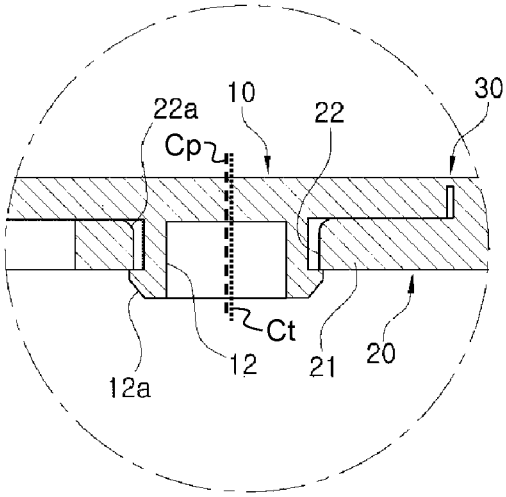
FIG. 5 is a view illustrating coupling of a protrusion and a through-hole in the disposable foldable spoon illustrated in FIG. 4.

In this case, as best seen in FIG. 5, the center Ct of the through-hole 22, into which the protrusion 12 is inserted, may be offset from the center Cp of the protrusion 12 and may be biased to the bending part 30. For example, the center Ct of the through-hole 22, into which the protrusion 12 is inserted, may be biased to the bending part 30 by a distance of 0.2 mm.

Because the center Ct of the through-hole 22, into which the protrusion 12 is inserted, is offset from the center Cp of the protrusion 12 and biased to the bending part 30, a portion of the protrusion 12 that is adjacent to the bending part 30 in the first place (before the handle is folded) is smoothly inserted into the through-hole 22 in the process of inserting the protrusion 12, so that the through-hole 22 and the protrusion 12 may be easily engaged with each other. Furthermore, when the through-hole 22 and the protrusion 12 are engaged with each other, a reduced space is formed between a portion of the protrusion 12 that is relatively far away from the bending part 30 in the first place (before the handle is folded) and the inner surface of the through-hole 22. Accordingly, even though an external force is applied in any one direction, the stopped state of the stopper 12*a* is maintained so that the protrusion 12 may be prevented from being separated from the through-hole 22.

Here, the through-hole 22 has a curved section 22*a* formed on the inner circumferential surface of one end thereof, into which the protrusion 12 is inserted. Accordingly, the protrusion 12 that makes contact with the curved section 22*a* is guided toward the center Ct of the through-hole 22 and smoothly inserted into the through-hole 22.

Meanwhile, the handle 20 may have an opening 23 formed between opposite side surfaces thereof.

In the case where the opening 23 is formed between the opposite side surfaces of the handle 20, a space may be secured between the body 10 and the handle 20 by the opening 23, with the handle 20 completely folded. Accordingly, in the process of forming the disposable foldable spoon A according to the present application, it is not necessary to separate a mold for forming the body 10 and a mold for forming the handle 20. As a result, the mold structure may be simplified, which makes it possible to prevent degradation in the durability of the bending part 30 as well as to easily form a product.

Furthermore, in the case where the opening 23 is formed, an inclined portion 31 may be additionally included in a portion of the body 10 that is adjacent to the bending part 30 and/or a portion of the handle 20 that is adjacent to the bending part 30.

The inclined portion 31 is formed to be downwardly inclined from the top surface to the bottom surface of the body 10 and/or the handle 210 so that the bending part 30 has a V-shaped groove. Accordingly, even though the handle 20 is folded in an opposite direction to the direction in which the handle 20 is engaged with the protrusion 12, the bending part 30 is easily bent and is prevented from being broken. As a result, damage to the bending part 30 may be prevented.

In this case, fastening recesses 24 may be formed on the top surfaces or the bottom surfaces of distal end portions of the handle 20 having the opening 23 formed therein, and the distal end portions of the handle 20 are fastened to each other by crossing the fastening recesses 24.

The bending part 30 is formed between the body 10 and the handle 20 so as to be thinner than the other parts to allow the handle 20 to be folded or unfolded.

The bending part 30 is just for folding or unfolding the handle 20 and does not have a special function. Therefore, detailed description of the bending part 30 will be omitted.

Meanwhile, the body 10 and the handle 20 are preferably formed of polypropylene. Polypropylene has flexibility due to the nature of the material, and therefore the handle 20 is smoothly folded or unfolded.

Detailed description of the use of the disposable foldable eating tool, specifically, the disposable foldable spoon A according to the present application will be given below.

In the present application, the handle 20 extending from the distal end of the body 10 is folded to minimize the volume before use. Therefore, the handle 20 is required to be unfolded for use.

Figure 3:
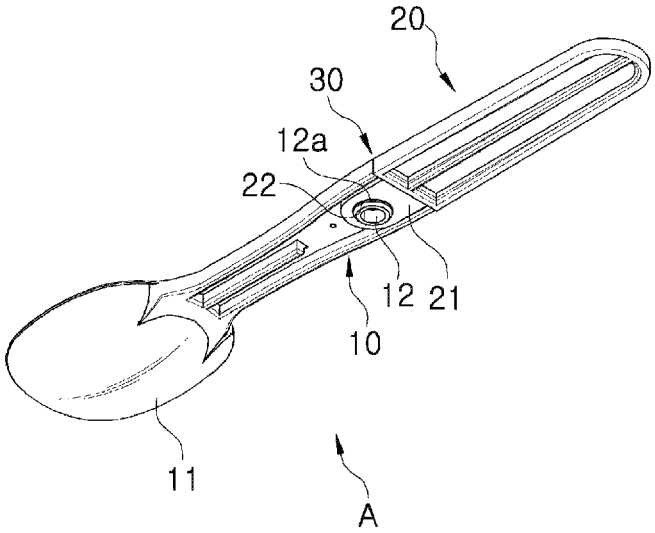
FIG. 3 is a rear perspective view illustrating an in-use state of the disposable foldable spoon illustrated in FIG. 1.

Because the bending part 30 formed to be thinner than the other parts is provided between the body 10 and the handle 20 of the present application, a distal end of the handle 20 may be smoothly raised by the bending part 30, and therefore the handle 20 is unfolded simply from the folded state as illustrated in FIG. 3.

Accordingly, a user may grasp the handle 20 in the unfolded state to eat food.

However, the user may have difficulty eating food in a case where the handle 20 is unintentionally folded while the user eats the food.

Figure 4:
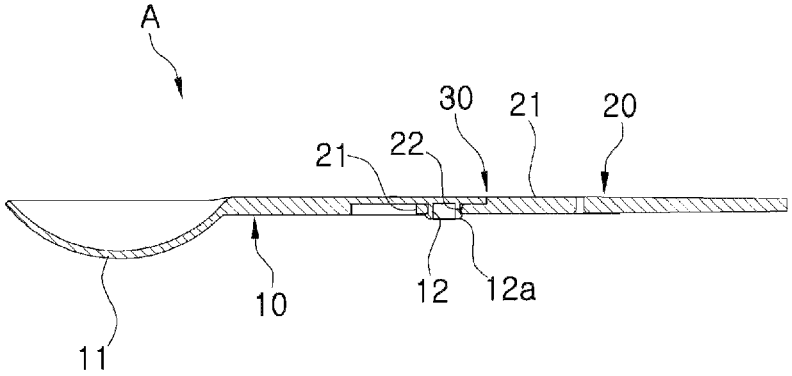
FIG. 4 is a sectional view illustrating the in-use state of the disposable foldable spoon illustrated in FIG. 1.

However, in the present application, the body 10 includes the protrusion 12 on the bottom surface of the distal end portion thereof, the protrusion 12 includes the outwardly protruding stopper 12*a* around the lower end thereof, and the handle 20 includes, at the tip end thereof, the extension piece 21 having the through-hole 22 formed therein. When the handle 20 is unfolded, as illustrated in FIG. 4, the protrusion 12 is inserted into the through-hole 22, and the protrusion 12 and the extension piece 21 are engaged with each other. Accordingly, the coupled state of the body 10 and the handle 20 is stabilized, and the handle 20 is prevented from being unintentionally folded while the user eats food.

In particular, in a case where an external force is applied downward to the tip end of the body 10, that is, to the bowl 11, the protrusion 12 may be separated from the through-hole 22, and the extension piece 21 and the protrusion 12 may be disengaged from each other. As a result, the handle 20 may be unintentionally folded. However, in the present application, the protrusion 12 includes the outwardly protruding stopper 12*a* around the lower end thereof, and when the protrusion 12 is inserted into the through-hole 22, as illustrated in FIG. 5, the stopper 12*a* is stopped by the circumference of the one end of the through-hole 22. Accordingly, even though the external force is applied downward to the tip end of the body 10, that is, to the bowl 11, the protrusion 12 is prevented from being unintentionally separated from the through-hole 22. As a result, the engagement of the extension piece 21 and the protrusion 12 may be stabilized, and the handle 20 is maintained in the unfolded state.

In this case, because the stopper 12*a* is formed such that the height h from the upper end of the stopper 12*a* to the upper end of the protrusion 12 is equal to the thickness t of the extension piece 21, a vertical movement of the extension piece 21 is prevented when the stopper 12*a* is stopped by the circumference of the one end of the through-hole 22. Further, the stopper 12*a* is formed such that the outer diameter of the lower end portion is smaller than the outer diameter of the upper end portion. In other words, the stopper 12*a* is formed in a wedge shape. Accordingly, the stopper 12*a* is easily inserted into the through-hole 22. Furthermore, the stopper 12*a* is formed such that the outer diameter of the upper end portion of the stopper 12*a* is larger than the inner diameter of the through-hole 22. Accordingly, when the protrusion 12 is inserted into the through-hole 22, the upper end portion of the stopper 12*a* passes through the through-hole 22 and is then fixedly stopped by the circumference of the one end of the through-hole 22.

Moreover, the protrusion 12 is formed in a hollow shape, and therefore the stopper 12*a* is smoothly inserted into the through-hole 22.

In addition, the body 10 may include a reinforcing rib 13 formed at an edge of a front surface and/or a rear surface thereof, and the robustness of the body 10 may be improved by the reinforcing rib 13.

Figure 6:
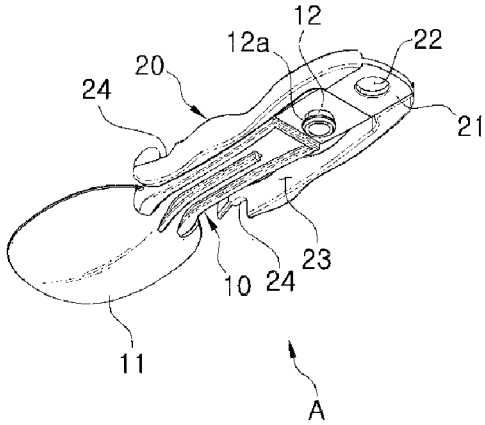
FIG. 6 is a rear perspective view of a disposable foldable spoon according to another embodiment of the present application, where the disposable foldable spoon is in a not-in-use state.

Meanwhile, in the disposable foldable spoon A according to the present application, as illustrated in FIG. 6, the handle 20 may have the opening 23 formed between the opposite side surfaces thereof.

Figure 7:
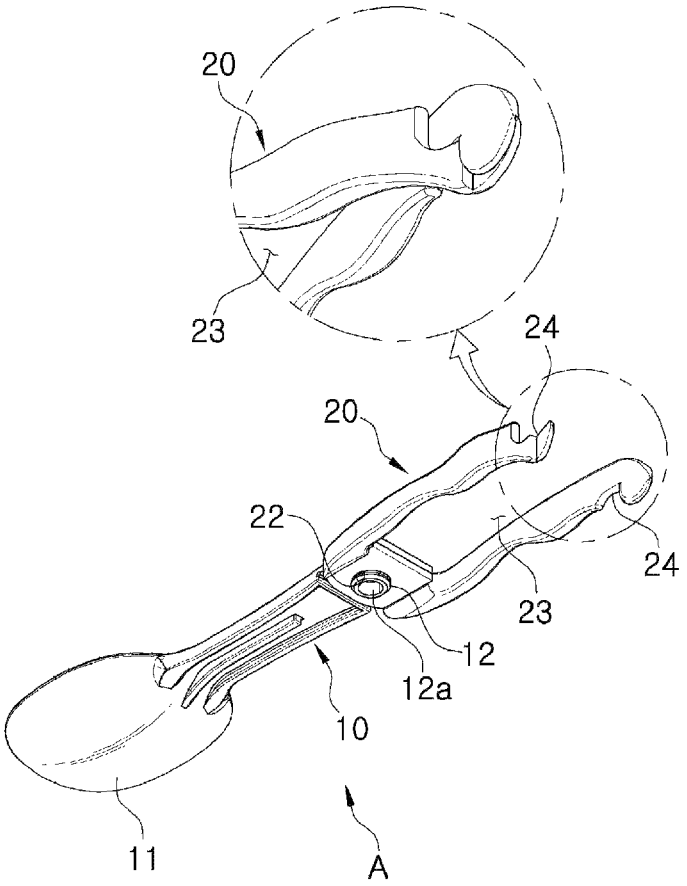
FIG. 7 is a rear perspective view illustrating an in-use state of the disposable foldable spoon illustrated in FIG. 6.

In this case, as illustrated in FIG. 7, the fastening recesses 24 may be formed on the top surfaces or the bottom surfaces of the distal end portions of the handle 20 having the opening 23 formed therein.

Accordingly, the distal end portions of the handle 20 are fastened to each other by crossing the fastening recesses 24, and thus the durability of the handle 20 is improved. As a result, a grasp on the handle 20 is stabilized irrespective of the formation of the opening 23.

Figure 8:
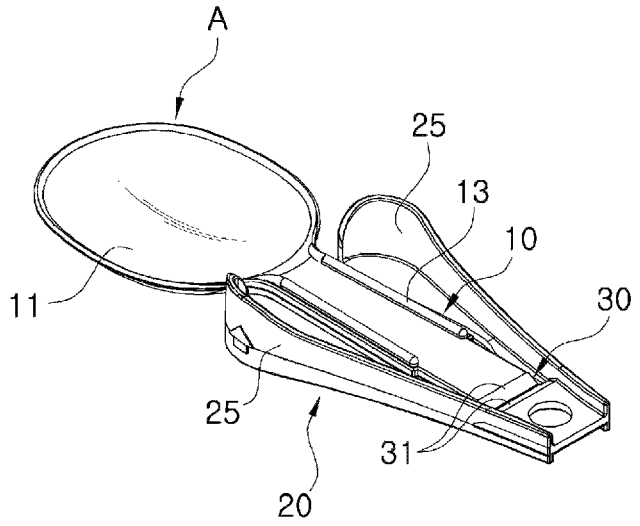
FIG. 8 is a front perspective view of a disposable foldable spoon according to yet another embodiment of the present application, where the disposable foldable spoon is in a not-in-use state.

In the disposable foldable spoon A according to the present application, as illustrated in FIG. 8, the handle 20 may include ribs 15 extending upward or downward from edges thereof.

The ribs 25 raise the strength of the handle 20, and therefore the grasp on the handle 20 may be further stabilized.

Figure 9:
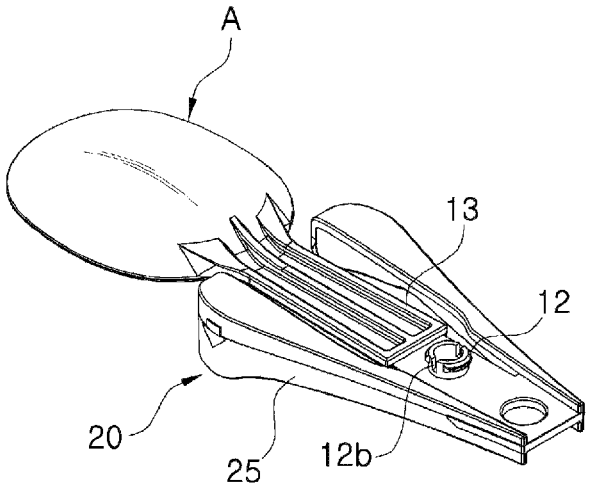
FIG. 9 is a rear perspective view of the disposable foldable spoon illustrated in FIG. 8.

In addition, in the disposable foldable spoon A according to the present application, as illustrated in FIG. 9, the protrusion 12 of the body 10 may have openings 12*b* formed therein.

The openings 12*b* allow the protrusion 12 to elastically deform, more specifically, contract when pressed. Accordingly, when the protrusion 12 is pressed while being engaged with the through-hole 22, the protrusion 12 contracts due to the openings 12*b* and may be smoothly inserted into the through-hole 22.

The protrusion 12 contracted by the pressure in the process of engaging with the through-hole 12 returns to the original state prior to the contraction after the pressure is released, more specifically, the protrusion 12 is completely inserted into the through-hole 22. Accordingly, the coupled state of the protrusion 12 and the through-hole 22 may be stabilized.

As described above, in the disposable foldable spoon A according to the present application, the body 10 includes the protrusion 12 including the stopper 12*a*, and the handle 20 includes the extension piece 21 having the through-hole 22 formed therein. When the handle 20 is unfolded and the protrusion 12 is inserted into the through-hole 22 of the extension piece 21, the extension piece 21 and the protrusion 12 are engaged with each other, and the stopper 12*a* passing through the through-hole 22 is stopped by the circumference of the one end of the through-hole 22. Accordingly, the protrusion 12*a* is prevented from being separated from the through-hole 22, and thus the body 10 and the handle 20 may be firmly coupled together.

The present application described above is not limited to the above-described embodiment, but various changes and modifications can be made therein without departing from the subject matters of the present application, and such changes and modifications fall within the spirit and scope of the present application.

LIST OF REFERENCE NUMERALS

| | |
|---|---|
| 10: Body | 11: Bowl |
| 12: Protrusion | 12a: Stopper |
| 12b: Opening | 13: Reinforcing Rib |
| 20: Handle | 21: Extension Piece |
| 22: Through-hole | 22a: Curved Section |
| 23: Opening | 24: Fastening Recess |

-continued

| | |
|---|---|
| 25: Rib | 30: Bending part |
| 31: Inclined Portion | h: Height |
| t: Thickness | A: Disposable Foldable Spoon |

The invention claimed is:

1. A disposable foldable eating tool comprising:

a body;

a handle extending from a distal end of the body; and a bending part formed between the body and the handle to allow the handle to be folded or unfolded, wherein the body includes a protrusion protruding downward from a bottom surface of a distal end portion of the body, and the protrusion includes an outwardly protruding stopper around a lower end of the protrusion, wherein the protrusion includes a first portion which is a furthermost part from the bending part and a second portion which is a closest part to the bending part, and wherein the handle includes an extension piece with a constant thickness that extends from a tip end of the handle and has a through-hole formed through a top surface and a bottom surface of the extension piece, wherein the stopper is pressed and deformed inward by an inner surface of the through-hole when the protrusion is inserted to the through-hole, and wherein the center of the through-hole, into which the protrusion is inserted, is between the bending part and the center of the protrusion after insertion of the protrusion into the through-hole so that the first portion contacts the inner surface of the through-hole before the second portion contacts the inner surface of the through-hole when the protrusion is being inserted into the through-hole and a gap between the first portion and the inner surface of the through-hole is smaller than a gap between the second portion and the inner surface of the through-hole after insertion of the protrusion.

2. The disposable foldable eating tool of claim 1, wherein the protrusion is formed in a circular shape.

3. The disposable foldable eating tool of claim 1, wherein the protrusion is formed in a hollow shape.

4. The disposable foldable eating tool of claim 1, wherein the stopper is formed such that a height from an upper end of the stopper to an upper end of the protrusion is equal to a thickness of the extension piece.

5. The disposable foldable eating tool of claim 1, wherein the stopper is formed such that an outer diameter of a lower end portion is smaller than an outer diameter of an upper end portion.

6. The disposable foldable eating tool of claim 1, wherein the stopper is formed such that an outer diameter of an upper end portion of the stopper is larger than an inner diameter of the through-hole.

7. The disposable foldable eating tool of claim 1, wherein the through-hole includes a curved section formed on an inner circumferential surface of one end of the through-hole into which the protrusion is inserted.

8. The disposable foldable eating tool of claim 1, wherein the handle includes an opening formed between opposite side surfaces of the handle.

9. The disposable foldable eating tool of claim 8, wherein an inclined portion is formed on a portion of the body that is adjacent to the bending part and/or a portion of the handle that is adjacent to the bending part.

10. The disposable foldable eating tool of claim 1, wherein the body and the handle are formed of polypropylene.

* * * * *